United States Patent [19]

Baranowski, Jr.

[11] 4,255,124

[45] Mar. 10, 1981

[54] STATIC FLUID-SWIRL MIXING

[76] Inventor: Frank Baranowski, Jr., 7 Pine St., Lynnfield Center, Mass. 01940

[21] Appl. No.: 948,961

[22] Filed: Oct. 5, 1978

[51] Int. Cl.[3] ..... F23D 15/02

[52] U.S. Cl. ..... 431/353; 48/180 C; 48/180 F; 239/466; 239/487; 366/338

[58] Field of Search ..... 431/353, 352, 351, 354; 366/337, 338, 336; 48/180 C, 180 R, 180 F; 239/466, 487

[56] References Cited

U.S. PATENT DOCUMENTS

| | | | |
|---|---|---|---|
| 1,860,347 | 5/1932 | Crowe | 239/487 |
| 1,947,866 | 2/1934 | McCourt | 431/353 |
| 2,216,846 | 10/1940 | Lewis | 48/180 C |
| 3,297,305 | 1/1967 | Walden | 366/338 |
| 3,663,154 | 5/1972 | Locke | 431/353 |
| 3,844,707 | 10/1974 | Wormser | 431/353 |
| 4,013,395 | 3/1977 | Wormser | 431/353 |
| 4,014,470 | 3/1977 | Burnham | 239/487 |
| 4,034,965 | 7/1977 | King | 366/336 |
| 4,179,222 | 12/1979 | Strom et al. | 366/337 |

FOREIGN PATENT DOCUMENTS

| | | | |
|---|---|---|---|
| 2343352 | 3/1975 | Fed. Rep. of Germany | 366/337 |

*Primary Examiner*—Joseph Man-Fu Moy
*Attorney, Agent, or Firm*—James E. Mrose

[57] ABSTRACT

In a jet torch of the type in which a venturi yields a high-velocity stream of air entrained with combustible gas released from a pressurized tank, the stream gases are mixed for reliable and efficient burning, while at the same time sidewall cooling and flashback-suppression are promoted, by thin crossed vanes edge-locked within the flame tube and bent without twist to deflect the stream gases about the cylindrical interior of the flame tube for resulting swirling motion.

4 Claims, 8 Drawing Figures

FIG. 1
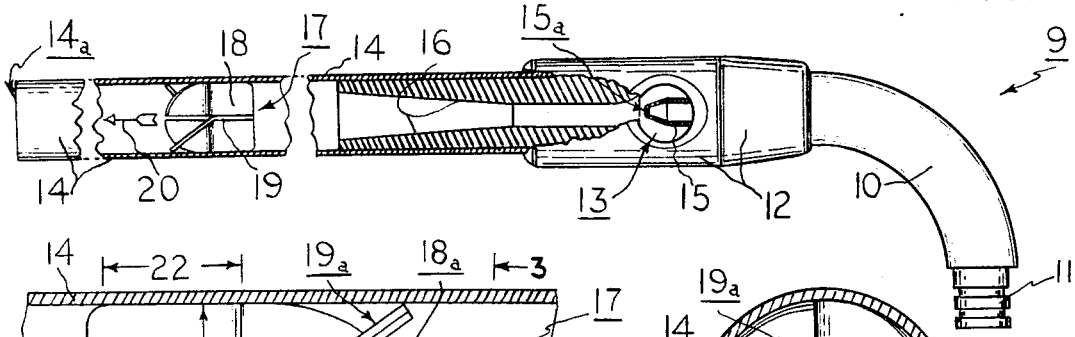
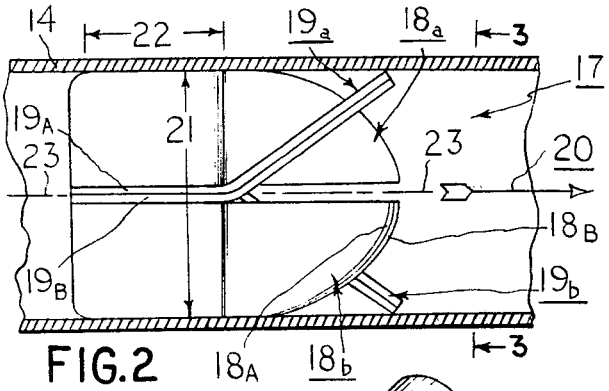
FIG. 2
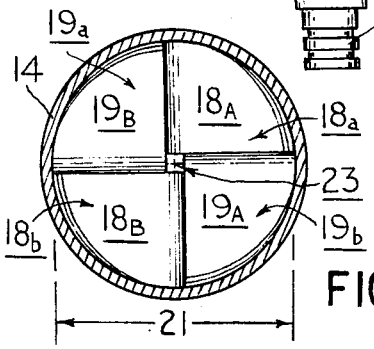
FIG. 3
FIG. 4
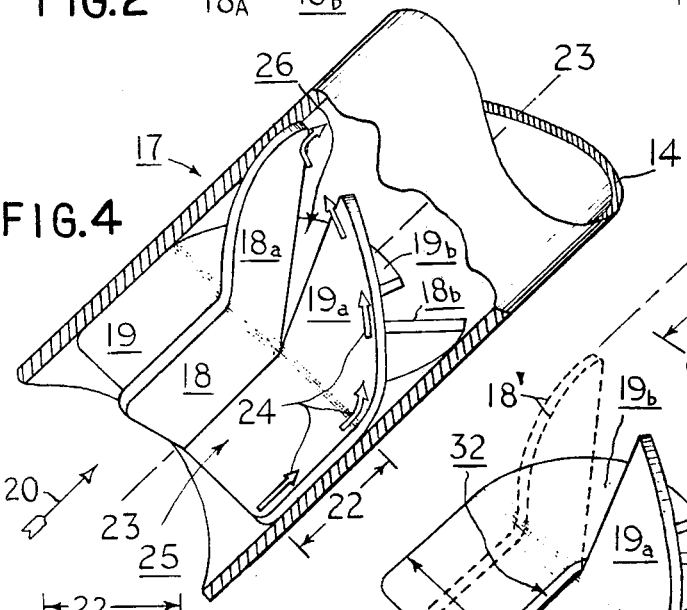
FIG. 5
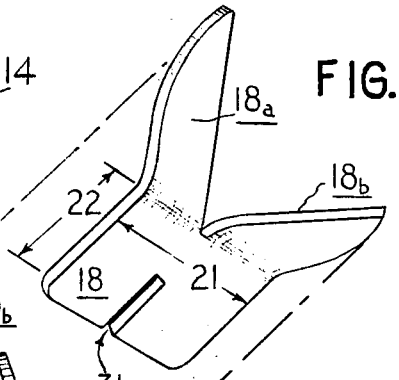
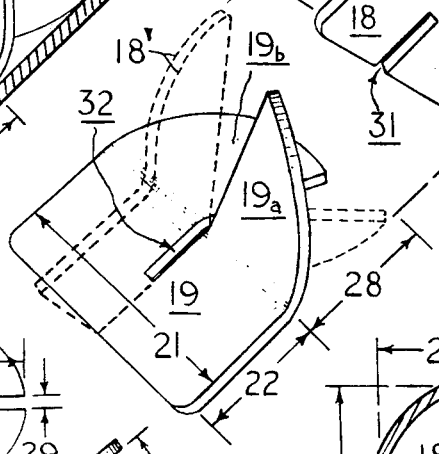
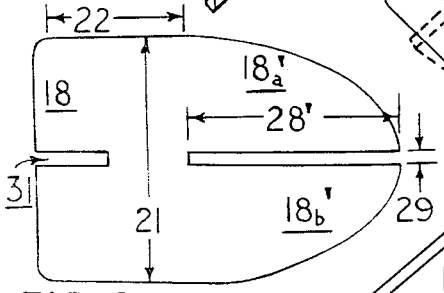
FIG. 6
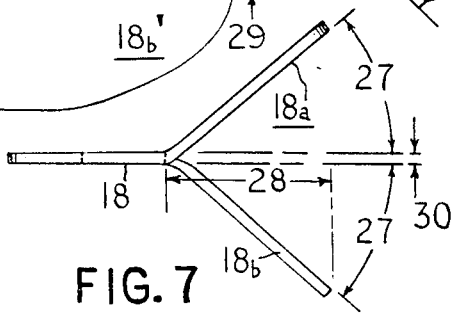
FIG. 7
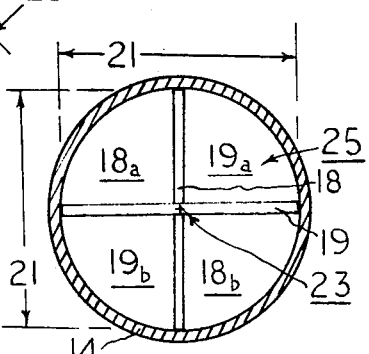
FIG. 8

STATIC FLUID-SWIRL MIXING

BACKGROUND OF THE INVENTION

The present invention relates to improvements in static fluid mixing, and, in one particular aspect, to novel and improved combinations of thin sheet-metal vanes crossed and locked within surrounding tubes to deflect fluids laterally into resultant curved paths of net motion, the vanes being of low-cost and readily-assembled form lending themselves well to fabrication of unique flameholders in jet-type gas torches and the like.

Gas-burning devices, in which ambient air is drawn along by a stream of combustible gas to produce a flame-sustaining mixture, have been known in a variety of forms, among which is the modern miniature torch fitted to a small tank of compressed gas and serving household and professional needs in such operations as soldering and brazing. In some constructions of such torches, a nozzle having a single small orifice directs a high-velocity jet of gas into the upstream end of a venturi while ambient air around the nozzle becomes entrained and flows thence with the gas through the venturi and into a downstream flame tube for a final mixing aimed at sustaining an ignitable and efficient-burning emission from the torch tip. An arrangement of that general type is disclosed in my U.S. Letters Pat. No. 3,768,962, for example. The final mixing, as well as control following entrainment and expansion actions in the venturi section, are preferably aided by stationary mechanical inserts which will cause blending and circulating and/or will shape the flame or impede flashback. Straight-passage machined inserts for burner mixer tubes are described in U.S. Pat. Nos. 2,888,979 and 3,198,239 and 3,574,506, and it is also known to fashion bluff-body mixer inserts with helical flow passages, as described in U.S. Pat. No. 4,013,395 for example. From very early times in the burner art, relatively thin twisted blades have been proposed for spiral gas-air mixing (U.S. Pat. Nos. 1,079,327 and 1,404,610 and 1,817,066), and other spiralling mixers have been shown more recently as resulting from the bending of vanes cut in thin disks (U.S. Pat. Nos. 3,844,707 and 3,915,623) or from the twisting of flat strips (U.S. Pat. No. 3,510,238). As appears more fully later herein, the present invention has to do with improvements in static fluid mixers having untwisted vanes which may be angled somewhat, as are the different blades of a flowmeter described in U.S. Pat. No. 4,056,977, and two of such vanes may also be slotted to interfit in an egg-carton-divider manner, as do the different multiplicity of strips of a grid spacer for a nuclear fuel reactor described in U.S. Pat. No. 4,039,379.

Fabrication and fitting of static mixers for small torches tends to involve quite significant cost and complication, and, in addition, one must carefully take into account their possible adverse influences on reliability and efficiency. Unless they thoroughly and properly combine the flowing gases, the resulting flames can fail to deliver optimum heat and can involve incomplete and fouling combustion. Moreover, if they are not securely located and held in place, even at extremely high temperatures, they may melt and/or be dislodged and allow uncontrolled flames to create serious hazards. Further, the shapings of small mixer passageways and bluff ends and the like can be critical in respect of the quality of resulting flame and the needed cooling of flame tube surfaces and the troublesome overheating of the mixer, such that expensive alloys and costly machining or casting may be required. In accordance with the present teachings, however, an uncomplicated low-cost static mixer employing very little volume of thin sheet material is cut and bent in a simple fashion and is self-locked tightly by edge-biting into the inner surfaces of a flame tube, to develop whirling streams which are the resultants of curved-ricochet type impingements of deflected flow from inclined planes against inner cylindrical walls of the tube and which will both cleanly burn and at the same time keep the tube walls cooled.

SUMMARY OF THE INVENTION

The present invention is aimed at creating improved static fluid mixers having mating parts which may be stamped inexpensively from thin sheet metal and then bent, slipped together, and simply sprung into self-locking fit within the flame tube of a burner. A perferred embodiment includes a pair of slightly elongated metal strips each slotted longitudinally to allow the other to fit with it in mutually-crossing relationship, and each having a lateral span at its upstream end which is substantially equal to or just greater than the cylindrical internal diameter of a flame tube into which the unit is to be pressed with both strips crossing the interior diametrically. For a considerable distance from their upstream ends, the thin crossed strips are wholly flat and have side surfaces which are purely diametric, such that all the gas flows past them substantially unimpeded and linearly, and involves negligible interference which might otherwise produce unwanted pressure drops. However, near their downstream ends, the same strips create a substantially-100% visual blocking of the flame tube, albeit no comparable flow blockage, as the result of the sloping of the downstream end of each half strip as an inclined plane, in relation to the upstream remainder of that half strip. Such visual blockage is significant because it characterizes an attendant important condition in which none of the flowing fluid can simply pass through without interacting with the mixer, and because it also characterizes a further important condition wherein possible flashback of downstream flame is inhibited. Preferably, each of the downstream strip ends inclines to the side, in the same angular sense as the others in the cluster (i.e., clockwise or counterclockwise), but as an inclined plane and without any significant angular twisting whatsoever, and its outer periphery is contoured to make substantially full line contact with surrounding inner surfaces of the flame tube, leaving no spaces for fluid flow except as intended through the four angularly-arranged passageways formed between the front faces of the inclined ends and the confronting backs of adjacent inclined ends and the surrounding cylindrical walls of the flame tube. Onrushing high-velocity gases from an upstream venturi will first flow straight through the four quadrants of the flame tube, as subdivided by the upstream diametrically-crossed ends of the crossed thin strips, and, then, in each such quadrant, the gases are deflected laterally and outwardly as they encounter an inclined-plane strip end, with the result that they are further guided by surrounding cylindrically curved inner surface into a helically-advancing path of net motion. In the course of such interaction, some of the gases must also force themselves against and/or be guided by the similarly-inclined back of an adjacent inclined-plane strip end, which will also promote the same helically-advancing net motion. All spaces within the tube are filled with the gases, of course, with some portions involving different speeds and net directions of flow in relation to the others, such that excellent gas-air mixing is assured. Because of the active role played by cylindrical inner surfaces of the flame tube in developing the desired net motions, those surfaces are constantly being intimately scrubbed by high-velocity gas stream, and they therefore tend to be very efficiently cooled even though exceedingly hot flames appear further within the interior of the flame tube. As the four gas streams leave the downstream end of the static mixer with the desired net helical motions, they slip past only very thin knife-like ends of the strips, and past only a minute central cross-over point, and ignition and intense burning downstream of those ends and point therefore does not result in any significant conduction of heat back into the mixer where thermal build-up might otherwise cause burn-out or softening and resulting hazard with an uncontrolled flame and overheating of the entire torch.

Accordingly, it is one of the objects of the present invention to provide a low-mass economical sheet-metal static mixer for burners and the like in which a pair of interfitting crossed thin strips self-locking themselves reliably in place when press-fitted within a surrounding circularly cross-sectioned tube and exhibit a cluster of downstream integral bent ends which deflect flow against inner tube surfaces for resultant helical-path motion, the mixer bent ends providing a substantially total visual occlusion which promotes full mixing and restrains blowout and flashback.

Another object is to reduce costs and complexities associated with flameholders in gas burners, and at the same time to develop highly efficient burning with attendant reliable self-cooling of burner parts, by way of thin crossed strips which have laterally-bent ends forming inclined planes which direct flowing gas-air mixtures helically-advancing streams as the result of interactions with curved interior surfaces of a flame tube.

BRIEF DESCRIPTION OF THE DRAWINGS

Although those aspects of this invention which are considered to be novel are expressed in the appended claims, further details as to preferred practices and as to further objects and features thereof may be most readily comprehended through reference to the following detailed description when taken in connection with the accompanying drawings, wherein:

FIG. 1 is a pictorial illustrations, with portions broken away, of a gas torch embodying the present invention;

FIG. 2 provides an enlarged and partly cross-sectioned detail of an improved static mixer and flame tube combination of the type appearing in the FIG. 1 embodiment;

FIG. 3 is a transverse cross-section taken along section line 3—3 in FIG. 2;

FIG. 4 views an improved mixer and flame tube in perspective, with a portion of the tube being cut away to expose the mixer and related flow-path markings;

FIG. 5 provides an exploded representation of two parts of a preferred static mixer unit, together with dashed line-work characterizing their mating relationship;

FIG. 6 supplies a side view of one of the strips forming the unit of FIG. 5, before bending;

FIG. 7 depicts the FIG. 6 strip from the top, after bending of its downstream ends to inclined-plane relationships; and FIG. 8 is an end view, from upstream, of a combination such as that of FIG. 4.

DETAILED DESCRIPTION OF THE PREFERRED EMBODIMENTS

Having reference to the drawings, wherein like reference characters designate identical or corresponding components and units throughout the several views, and in the first instance to FIG. 1 thereof, there is illustrated a gas torch 9 of generally elongated form having an inlet tube 10 equipped at its upstream end with a coupling 11 designed to be connected in sealed swiveling relationship with the outlet of a pressure-regulator body, such as that disclosed in my U.S. Pat. No. 3,699,998, for example. A pressurized gas, such as propane, is directed into inlet tube 10 from a small tank or the like, through the regulator, and becomes associated with ambient oxygen-supplying air in a tubular base 12 having lateral air-admitting openings such as 13. In downstream relation to base 12 is a flame tube 14, whence the admixed gas and air are intended to discharge as an ignitable high-velocity stream which will burn with intense heat and in a rather narrowly defined flame exiting from flame tube tip 14*a*.

Apertured base 12 supports an upstream nozzle element 14 and an axially-spaced downstream venturi element 16 which, together, produce a jet-pump action entraining air via the lateral openings such as 13 and, further, cause the gas and air to be combined and expelled at high velocity. Tapered nozzle element 15 has an accurately centered minute orifice 15*a* from which a needle-like jet of gas is directed in a close axial alignment and centering with the upstream end of venturi element 16. Optimum mixing of the gas and air, and guidance of the flow in such fashion as to promote efficient burning in a controlled manner as well as cooling of the flame tube, are brought about with the aid of static mixer unit 17. That unit, which may also be termed a flameholder, is formed of interfitting thin metal strips and plainly lacks any hub and bluff volumes of bulk material such as have been cardinal features of prior flameholders for popular small torches.

Rather than simply involving helical channeling near the periphery of a solid mass of metal, according to known practice which is both rather costly and can lead to problems with the fastening and retaining of such a flameholder securely in place, the mixer 17 will develop desirable helical- or spiralling-streams without itself having helically curved surfaces, and it will self-lock and hold after being pushed into place, even at extremely high temperatures and under buffeting from high-velocity flows of gases. As appears more fully hereinafter, mixer 17 need only involve two thin sheet-metal strips, 18 and 19, which fit together by way of accommodations provided by complementary longitudinal slotting, and which are substantially straight and flat along their upstream portions while having downstream end portions which are bent into planes inclined in relation to the upstream portions. In one preferred practice, characterized by the showings in FIGS. 2 and 3, the two strips are each made up as the composite of two identical thinner strips abutted and aligned side-by-side, as shown by halves 18A–18B and 19A–19B. The sheet metal of which the strips are formed is desirably very springy and hard, and can withstand high temperatures; further, it must be cut to very closely controlled dimensions so that certain advantages interference fits can be realized. Accordingly, accurate stamping of such strips from half-thickness material, with subsequent pairings to make up the wanted total thickness, can be of benefit in some instances. Stainless steel, phosphor-bronze, and beryllium copper are among the materials which may be suitable for the strips, and their effective springiness in a given total thickness is enhanced when the strips they form are composites of half-thickness stock.

The upstream side of flame tube 14 is at the left in FIG. 2, reversed from the showing at the right in FIG. 1, with the net downstream longitudinal flow direction being suggested by arrow 20 in both illustrations, even though net flow there is in fact made up of four helically advancing streams rather than one straight current. Importantly, the upstream ends of the mixer strips are wholly flat and of a uniform width, 21, corresponding to at least the same dimension as the inner diameter of tube 14, and preferably just slightly in excess thereof. Those upstream ends are also of the uniform width 21 over a sufficient length, 22, to preserve a non-skewing or concentrically aligned relationship between the central axis 23–23 of tube 14 and the central longitudinal axis of the mixer. As appears from the illustrations, the mixer strips are interfitted and crossed in mutually perpendicular relationship along their upstream ends, but, at their downstream ends they are bent to one side to form an array of four similarly inclined planar vanes, 18*a*, 18*b*, 19*a* and 19*b*, each of which is effective to visually occlude one quadrant of the cross-section of the flame tube (FIG. 3). In the latter connection, it should be observed that each of these vanes has a curved outer periphery or edge which substantially matches the inner curvature of flame tube 14 along which it extends, so as to block leakage of gaseous flow there, and that the inner edges of those vanes are substantially radially disposed.

Those conditions result in flow as characterized generally by the train of arrows 24 in FIG. 4. There, the upstream-to-downstream flow of a gas-air combination, in direction 20, is separated into four quadrants of flow by the crossed diametrically extending flat upstream portions of the thin single-thickness strips 18 and 19. In quadrant 25, for example, the flow at first proceeds substantially linearly, aided and straightened if necessary by those flat and linearly extending upstream portions of the mixer. As soon as the upwardly-inclined plane surface of vane 19*a* is encountered, the flow must perforce deflect upwardly against the surrounding inner surface of tube 14, and the vector resultants of forces cause the flow to advance downstream along a substantially helical course. One the thus-directed fluid leaves the mixer, through the substantially sector-shaped downstream "window" opening 26 defined between the front of vane 19*a* and the adjacent back of vane 18*a* and the surrounding tube 14, it continues to course along downstream in a substantially helical path, because of its continuing encounters with inner cylindrical surfaces of tube 14. None of the flow through quadrant 25 can escape such influences, inasmuch as vane 19*a* fully blocks all longitudinally aimed flow therethrough. With all volumes being substantially filled during operation of the system, there are of course interactions whereby some fluid volumes guide others, without engaging vane or tube surfaces directly, and wherein advantageous localized swirling and fine mixing will occur because of differences in velocities of nearby volumes of fluid, but the overall flow pattern is of the aforesaid helical character. Similar effects occur in each of the other quadrants at the same time, and there are thus four helically oriented streams issuing from them. These streams slip past the ends of the mixer vanes with negligible separation from one another, because the downstream edges of the vanes are so thin and knife-like, and the adjacent streams thereupon merge with one another with attendant circulations and mixing occuring at their interfaces as the result of velocity differentials and the like. All of the vanes in the downstream array are inclined to the same side, referenced to a given direction about longitudinal axis 23–23, and all have substantially the same angle of inclination, 27 (FIG. 7), in relation the flat upstream portions of the mixer strips.

The inclined vanes 18*a*, 18*b*, 19*a* and 19*b* can be bent into the desired array because of slotting of the strips 18 and 19 midway and longitudinally at their downstream ends, for a longitudinal distance 28 (FIGS. 5 and 7). Each of the slots is of a width 29 (FIG. 6) which is just minutely in excess of the total thickness 30 (FIG. 7) of the strips, and similar further central longitudinal slotting, 31 and 32 (FIG. 5), is provided over different half-lengths of the upstream ends of the two strips. The latter slots allow one of the shaped and bent strips to be interfitted with the other in the relationship as characterized in FIG. 5, the dashed linework 18' there representing the outline of strip 18 in its mated position crossing strip 19. Even though there is no hub in the crossed mixer assembly, the two strips thereof remain held in a mutually-perpendicular crossed relationship because of the firm fit between parallel sides of each strip and the transversely extending slot edge surfaces of the other into which it is sandwiched when the two parts are fitted together. As has been said, dimension 21 is made large enough to cause peripheral edges of the upstream portions of the strips to bite into interior surfaces of the tube 14 when the mixer is pressed into the desired position longitudinally within a flame tube from its tip opening 14*a*. Some intentional springing action is then developed, such that the edge biting is kept hard and the mixer will not thereafter become dislodged unintentionally. Similar biting occurs about the curved peripheries of the four inclined vanes.

As is depicted in FIG. 6, mixer strip 18 is first produced in flat thin metal stock form, having the needed longitudinal slotting and further having curvatures about its end halves 18*a'* and 18*b'* which will yield the needed peripheries conforming with inner cylinder surfaces of tube 14 when those end halves are bent flat in different lateral directions by angular amount 27 (FIG. 7). The other mixer strip, 19, is fashioned similarly, of course, although its upstream slotting is given the expected complementary location. Preferably, the angle 27 at which the inclined-plane vanes are bent to the side is in the range of about 40 to 60 degress, giving both a significant helical course to the high velocity gaseous streams and leaving four way significant "window" openings, each such as 26 in (FIG. 4), for the flow to travel through the torch with relatively small pressure drop and a minimum of obstruction. Not only is complete visual blockage readily obtainable, but that fact insures both that all forward flow will course helically with thorough mixing and that all flashback tendencies would meet with suppressive cooling and extinguishing influences of mixer.

The preferred practices and embodiments described in connection with this specification have been presented by way of disclosure rather than limitation, and it should be understood that various modifications, combinations and substitutions may be effected by those skilled in the art without departure either in spirit or scope from this invention in its broader aspects and as set forth in the appended claims.

What I claim as new and desire to secure by Letters Patent of the United States is:

1. A static mixer combination in a gas torch of the type in which a high-velocity combustible gaseous stream flows through the substantially cylindrical bore of a flame tube, comprising relatively thin mixer members having upstream support portions of springy sheet metal, said support portions of said members having longitudinally extending peripheral edges engaging longitudinally extending inner wall surfaces of said bore and elsewhere extending only substantially in radial directions within said bore, said support portions being of complementary configurations promoting their cooperating self-support of said members within said bore and subdividing said bore into plural flow passageways extending linearly along said tube, and flow-deflecting vane portions projecting downstream from support portions of said members as thin integral extensions thereof, said flow-deflecting vane portions being substantially flat and laterally bent to incline from said support portions at substantially the same angle and to one side, referenced to one angular direction about the longitudinal axis of said bore, said angle being in the range of about 40 to 60 degrees, said vane portions being inclined fully into curved peripheral engagements with inner wall surfaces of said bore, said flow-directing portions being bent from bifurcated ends of two mixer members each having support portions of width substantially equal to the diameter of said bore, said support portions of said two members having complementary slots midway therealong which accommodate mutually-perpendicular crossed interfittings therebetween in a longitudinally-aligned mated relationship, and each of the four vane portions being inclined to one side corresponding to one angular direction about the center of the crossed members, whereby said vane portions intercept flow through said passageways and promote substantially helical coursing of the flow downstream thereof in said flame tube.

2. A static mixer combination as set forth in claim 1 wherein said flow-directing vane portions together visually occlude substantially the full circular cross-section of said bore as viewed in direction of the longitudinal axis thereof, and wherein said peripheral edges of said support portions are pressed into biting engagements with said inner wall surfaces.

3. A static mixer combination as set forth in claim 2 wherein each of said thin members is in the form of a combination of two abutting thinner sheet-metal layers of identical outlines, and wherein said slots are of substantially the same width as said members and thereby cause the members to hold one another in mutually-perpendicular crossed relationship, and wherein the slot in one of said support portions is from the upstream end thereof and the slot in the other of said support portions is from the downstream end thereof, each of said slots being substantially half the length of said support portions.

4. A static fluid-swirl arrangement comprising a flow conduit having a passageway defined by substantially cylindrical inner walls, and a swirl-inducing insert within said passageway including an array of similarly-inclined relatively thin sheet-metal vanes each forming substantially an inclined plane the inclination of which in an upstream-to-downstream direction is laterally from the locus of substantially a radius of said passageway progressively outwardly and substantially fully to said inner walls, the inclinations of all of said vanes being to the same side, referenced to one angular direction about the longitudinal axis of said passageway, all of said vanes commencing outward inclination at substantially the same position longitudinally along said passageway and thence extending substantially from the center thereof to visually occlude substantially a full separate sector of the circular cross-section thereof, said vanes together visually occluding substantially the full cross-section of said passageway as viewed in direction of said longitudinal axis, each of said vanes being the integral downstream extension of a straight radially- and longitudinally-extending substantially planar support vane portion upstream thereof, the support vane portions together fitting within said cylindrical inner walls and having parallel longitudinally-extending outer edges which bind with said inner walls to afford locking support for said vane portions and their inclined-vane extensions, said inclined vanes and support portions therefor being of springy sheet metal, said inclined vanes being four in number with two pairs thereof being bent at substantially the same angle from bifurcated ends of two substantially rectangular support portions, each of said support portions being of width substantially equal to the diameter of said cylindrical inner walls of said passageway and making biting engagement therewith along its outer edges when pressed into diametrically-disposed relationship therein, and each of the two support portions being longitudinally slotted part way along its middle and in a complementary relation to the other enabling said two portions to be interfitted longitudinally in a mutually-perpendicular crossed relationship, whereby fluid flowing along said passageway is deflected by said vanes and by said inner walls to have resultant substantially-helical advancing swirling motion in one angular direction through said passageway.

* * * * *